US005220735A

United States Patent [19]

Raoul-Duval

[11] Patent Number: 5,220,735

[45] Date of Patent: Jun. 22, 1993

[54] POINTE SHOE

[75] Inventor: Franck Raoul-Duval, Monticello, Hong Kong

[73] Assignee: Dancing Bonzi Company, Hong Kong

[21] Appl. No.: 724,378

[22] Filed: Jun. 28, 1991

[30] Foreign Application Priority Data

Jul. 9, 1990 [GB] United Kingdom ..... 9015099

[51] Int. Cl.[5] ..... A43B 5/12; A43B 23/22; A43B 13/42

[52] U.S. Cl. ..... 36/8.3; 36/136; 36/108; 36/76 R

[58] Field of Search ..... 36/8.3, 76 R, 76 C, 36/43, 136, 132, 113, 107, 108

[56] References Cited

U.S. PATENT DOCUMENTS

| | | | |
|---|---|---|---|
| 79,941 | 7/1868 | Bertram | 36/76 R |
| 1,620,797 | 3/1927 | Bonaventure | 36/8.3 |
| 2,099,138 | 11/1937 | Norcross | 36/76 R |
| 2,157,818 | 5/1939 | Disch | 36/76 R |
| 5,084,986 | 2/1992 | Usui | 36/43 |

FOREIGN PATENT DOCUMENTS

| | | | |
|---|---|---|---|
| 9004338 | 5/1990 | European Pat. Off. . | |
| 1785260 | 1/1972 | Fed. Rep. of Germany . | |
| 0202621 | 9/1983 | Fed. Rep. of Germany | 36/8.3 |
| 7608160 | 11/1977 | France | 36/113 |
| 846965 | 9/1960 | United Kingdom . | |
| 2156652 | 10/1985 | United Kingdom | 36/8.3 |
| 2205480 | 12/1988 | United Kingdom | 36/8.3 |

*Primary Examiner*—Steven N. Meyers
*Assistant Examiner*—M. D. Patterson
*Attorney, Agent, or Firm*—Omri M. Behr; Matthew J. McDonald

[57] ABSTRACT

A pointe shoe is provided with a removable stiffening member 19 to enable inter alia the stiffeners of the shoe to be varied according to the characteristics of each chosen member 19, to replace the member 19 when the flexibility of the shoes becomes too great after normal use, and to extend the useful life of the remainder of the shoe.

11 Claims, 2 Drawing Sheets

POINTE SHOE

The present invention relates to a ballet shoe and in particular to a pointe shoe. Pointe or toe shoes for ballet comprise a sole portion, typically of leather, to which is attached a fabric upper of the shoe. A stiff insole is attached to the sole portion on the inside of the shoe by gluing, nailing or stitching to the sole and provides reinforcement for the sole to support the foot and prevent undue bending. The material, rigidity, length and shape of the insole are normally adapted to suit the requirements of the dancer or the part danced. Hence it is necessary for a range of shoe types to be stocked to suit a dancers needs, or for shoes to be made to order.

The present invention provides a pointe shoe having a sole portion, an upper attached to the sole portion an insole attached to the sole portion, and a separate removable stiffening member fitted between the sole portion and the insole.

Preferably, the stiffening member is slidable between the insole portion and the sole portion and frictionally held in position.

Preferably, the member is formed of bamboo wood.

By providing a separate removable stiffening member a range of stiffening members can be provided at the point of sale. The insole in a pointe ballet shoe is usually the first part to fail, becoming too flexible as a result of use or fracturing in an arch region of the dancers foot. The stiffening member can be made to use as a stiffening member after what would otherwise be regarded as failure of the insole, to reinforce or stiffen in effect the insole and prolong the useful life of the shoe after the failure or partial failure of the insole itself.

Other preferred features and advantages of the invention will be apparent from the following description and the accompanying claims.

The invention will be further described by way of example, with reference to the accompanying drawings, in which.

Figure 1:
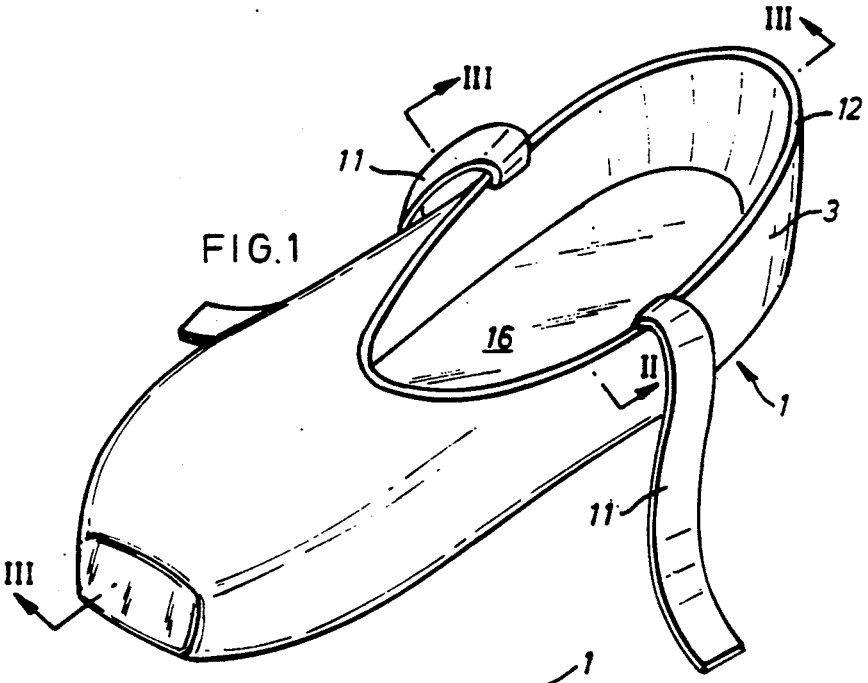
FIG. 1 is a perspective view of a ballet shoe according to the invention.
Figure 2:
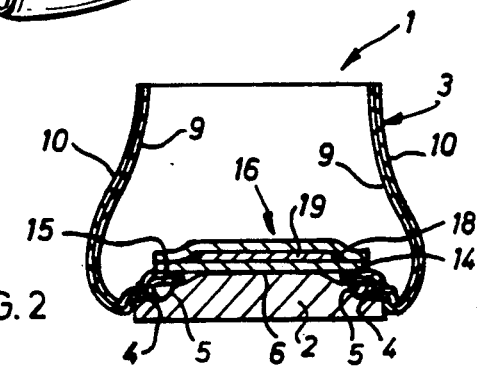
FIG. 2 is a cross-section along the line II—II of FIG. 1.
Figure 3:
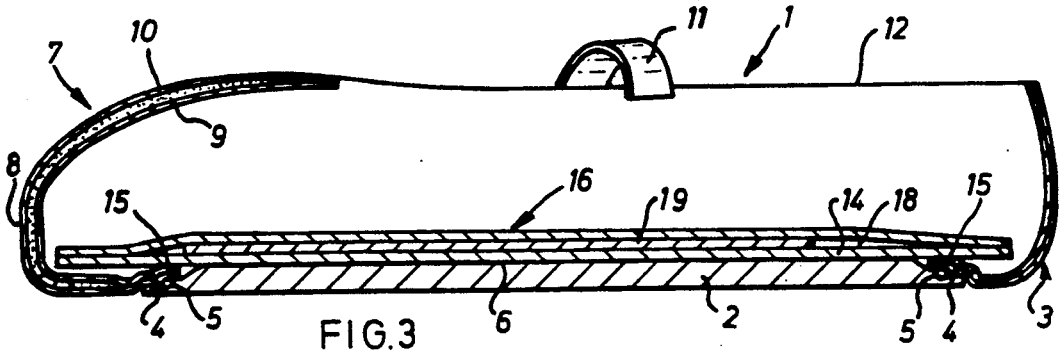
FIG. 3 is a cross-section along the line III—III of FIG. 1.
Figure 4:
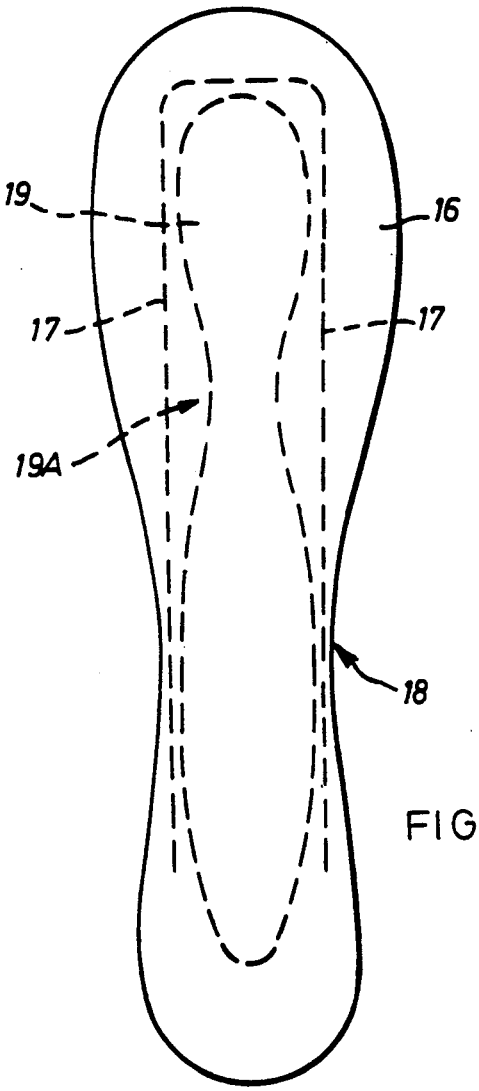
FIG. 4 is a plan view of a sole and insole for the ballet shoe.
Figure 5:
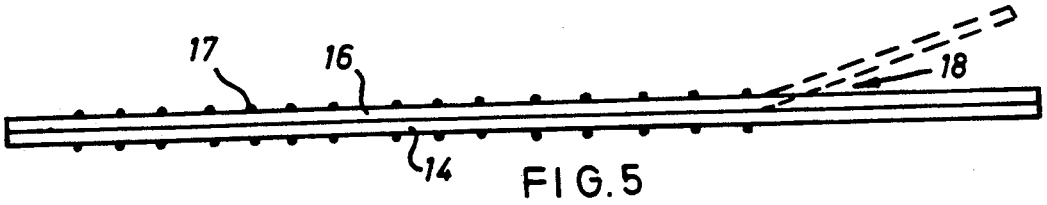
FIG. 5 is a side view of the sole and insole.

Referring to the drawings, a ballet shoe 1 is of the pointe or toe type and comprises a leather sole 2 and a fabric upper 3 sewn to the sole 2. The upper may be glued to the sole as well as or instead of sewing. The sole 2 is formed with a step 4 at its peripheral edge and the fabric upper is stitched to the edge by stitches 5 extending through the fabric into the step 4 and through the top 6 of the sole 2. In other forms, the stitching may pass vertically through the sole, the upper being on top, or the upper may be sandwiched between two layers of sole and held by stitching and/or gluing. The upper 3 has a hardened toe portion 7 formed by glue impregnated matting or a moulded plastic shell 8 housed between inner and outer skins 9, 10 of the fabric. Typically two or three layers of matting are used. Straps 11 may be stitched to the neck or border 12 of the upper 3. Often the shoes are sold without straps attached, these are sewn on by the dancer.

The construction thus far described is well known in the art and need n t be described in further detail here.

The shoe is provided with an insole as follows. A first layer 14 fabric is glued to the inside upper surface 6 of the sole 2. The layer may also be nailed to the sole. Preferably layer 14 covers the edge 15 of the upper material.

A second layer 16 comprises a stiff base formed of the usual insole material, for example of metal, plastics, cardboard or wood, and a pocket 18 is Provided between the layers 14 and 16.

The layer 16 is attached to the layer 14 by stitching 17 and/or by gluing at and surrounding the forward ends of the layers 14 and 16 so that a separate stiffening member 19 can slide into a pocket 18 provided between the layers 14 and 16. Normally, the member 19 is a tight fit in the pocket both laterally and axially of the central longitudinal axis of the shoe. In use, there is therefore sufficient frictional resistance between the member 19 and the inside surfaces of the pocket 18 so that the stiffening member 19 remains securely in position in the pocket when the shoe is worn. If desired however, a piece of sticky tape can be placed across the end of the member 19 to hold it in position at that region to the layer 14.

The member 19 may be provided in a variety of shapes. In particular it need not extend the full length of the pocket but may extend only half or three-quarters of the shoe length from the toe, where the user does not require particular stiffened support in the heel region. Where the dancer prefers a relatively "unstiffened" half pointe position for example, the member 19 is arranged not to extend fully into the toe region.

A range of members 19 may be provided, having a variety of lengths and types of materials, and thickness or stiffness. Different stiffnesses can be achieved by using the same material and same thickness but relatively widening or narrowing the plan form waist 19A as required for example. Strips of steel or other metallic material can be provided extending along part of the length of the member 19 to alter the bending characteristics of the shoe in a manner which can be tailor-made for any individual dancer according to personal choice.

The members 19 can be made of bamboo cut and shaped as required and of different thickness as desired to provide different stiffnesses. Bamboo wood is particularly suitable being generally readily available and easy to form into suitable shapes. The strip is cut from a suitably large radius bamboo shoot with its long axis generally parallel to the central longitudinal axis of the shoot and then smoothed and shaped as required. In use, the surface of the strip which was outermost in the shoot from which it is cut is placed in the pointe shoe nearest the sole of the dancer's foot. The inner most surface is placed in use against the layer 14.

Additionally, should the second layer 16 fracture or weaken by over-strain a stronger stiffening member 10 may be used to compensate for the weakened layer 10 and extend the useful life of the shoe.

It will be appreciated that the sole and upper may be of various materials as generally used in the art.

The described point shoe can be used without the stiffening member 19 for practice or as a "soft" shoe, when desired.

Generally, it is common practice with pointe shoes for a dancer to "artificially", that is to often, by hand, flex and manipulate a new pointe shoe before it is worn. The dancer then wears a shoe and during use the initial flexing and normal wear strains and stresses the sole to a point where the shoe is at its most comfortable and useful. Further use or wear causes the flexibility of the sole to deteriorate quite naturally to a situation where the shoe is too flexible. The shoe must then be discarded and sometimes, certainly with professional dancers, presently available pointe shoes may be worn only for a few hours or one performance. By using shoes according to the present invention, while the natural flexing during use will as before and normally weaken the sole, and in these cases the member 19 as well, the ready replacement of a new member 19 in a used shoe lengthens the acceptable working life of each shoe considerably if not indefinitely in this regard.

Further, as described the member 19 can be designed overall and also at specific parts along its length, by shaping or adding metal strips, to suit each individual dancers requirements. This enables at comparatively little cost to provide a "tailor'made" shoe for any particular dancer's requirements as well as considerably extending the useful life of each pair of shoes.

I claim:

1. A pointe shoe having a sole portion, said sole portion having a front end and a rear end, an upper attached to the sole portion, an insole attached to the sole portion to form a pocket open adjacent said rear end, and a separate removable stiffening member fitted between the sole portion and the insole portion of said pocket, said stiffening member comprising a strip of bamboo wood.

2. A pointe shoe according to claim 1 in which the stiffening member is slidable between the sole portion and the insole in a direction toward said front and rear ends, and dimensioned to form a tight fit in said pocket.

3. A pointe shoe according to claim 1 in which the stiffening member is narrower than the sole portion.

4. A pointe shoe according to claim 1 in which the stiffening member is shorter than the sole portion.

5. A pointe shoe according to claim 1 in which the stiffening member has in plan view the form of a waisted finger.

6. A pointe shoe according to claim 1 in in which the stiffening member is formed of paper board or cellulose fibre board.

7. A pointe shoe according to claim 1 wherein said bamboo wood comprises a strip cut from a bamboo shoot having a long axis, said strip being cut along the long axis.

8. A pointe shoe according to claim 7 wherein said shoot has an outer peripheral surface, the strip having first and second opposing major surfaces, one of said surfaces being closest to the outer peripheral surface of said shoot when cut from said shoot, said one surface of said strip being contiguous with said insole.

9. A pointe shoe comprising:

a sole portion;

an upper secured to the sole portion;

an insole secured to the sole portion; and a stiffening member secured to the sole portion between the sole portion and the insole, said stiffening member comprising a strip of bamboo cut from a bamboo shoot having a long axis, said strip being cut along the long axis.

10. The pointe shoe of claim 9 wherein said shoot has an outer peripheral surface, the strip having first and second opposing major surfaces, one of said surfaces being closest to the outer peripheral surface of said shoot when cut from said shoot, said one surface of said strip being contiguous with said insole.

11. The pointe shoe of claim 10 wherein said member comprises a planar sheet-like material whose broad planar surfaces form said major surfaces.

* * * * *